US006463390B1

(12) United States Patent
Miyamori et al.

(10) Patent No.: US 6,463,390 B1
(45) Date of Patent: Oct. 8, 2002

(54) SETTING METHOD AND DEVICE FOR WAVEFORM GENERATOR WITH A PLURALITY OF WAVEFORM GENERATING MODULES

(75) Inventors: Hideo Miyamori; Hiroshi Isobe, both of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/342,580

(22) Filed: Jun. 29, 1999

(30) Foreign Application Priority Data

Jul. 1, 1998 (JP) ..... 10-185906

(51) Int. Cl.[7] ..... G10H 7/00

(52) U.S. Cl. ..... 702/68; 702/66; 702/67; 702/71

(58) Field of Search ..... 702/66–68, 70, 702/71, 75–77, 106, 107, 124, 126, 183, 184, FOR 107–110, FOR 103–104, FOR 134–135, FOR 170–171; 704/205, 207; 84/603, 604, 622, 659

(56) References Cited

U.S. PATENT DOCUMENTS 5,596,159 A * 1/1997 O'Connell ..... 84/622
5,750,911 A 5/1998 Tamura ..... 84/602
5,895,877 A 4/1999 Tamura ..... 84/625
5,898,118 A * 4/1999 Tamura ..... 84/602
5,973,251 A * 10/1999 Mukojima et al. ..... 84/602
5,981,860 A * 11/1999 Isozaki et al. ..... 84/603
6,180,863 B1 * 1/2001 Tamura ..... 84/603
6,271,454 B1 * 8/2001 Tamura ..... 84/603
6,288,991 B1 * 9/2001 Kajiyama et al. ..... 369/47.23
6,291,757 B1 * 9/2001 Yamanoue ..... 84/615

* cited by examiner

*Primary Examiner*—Marc S. Hoff
*Assistant Examiner*—Carol S. Tsai
(74) *Attorney, Agent, or Firm*—Morrison & Foerster

(57) ABSTRACT

Integrated software tone generator is made up of software of a software tone generator driver and software of a plurality of modules, such as a tone generator module, registered in the driver for executing generation and/or processing of a waveform. A property sheet is displayed as a setting screen to make various settings for the integrated software tone generator via respective windows. In the property sheet, there are displayed a tab for selecting a common setting mode and tabs for individually selecting one of individual modules, and a dialog box corresponding to one of the tabs which is selected by a user's click operation is opened and displayed. When the dialog box for the common setting is opened, there is displayed a menu of predetermined common setting items shareable by the plurality of modules, and settings are made for the common setting items by a user doing a desired input to the menu. When, on the other hand, the dialog box for setting one particular module is opened, there is displayed a menu of predetermined items peculiar to the particular module, and settings are made for the peculiar items by the user doing a desired input to the menu.

17 Claims, 6 Drawing Sheets

SETTING METHOD AND DEVICE FOR WAVEFORM GENERATOR WITH A PLURALITY OF WAVEFORM GENERATING MODULES

BACKGROUND OF THE INVENTION

The present invention relates to a setting method and device for use in a waveform generator that includes a plurality of modules for executing generation and/or processing of waveform data, a tone generating method and device, and a recording medium having stored therein a program to cause a computer to carry out these methods. More particularly, the present invention relates to a technique which allows a user to make settings for a plurality of waveform generating or processing modules while viewing a setting screen or panel on a video display.

Various tone generator apparatus have been known which include a plurality of tone generating systems and can selectively use one of the tone generating systems that is desired by a user or suitable for a selected tone color. However, there has been no tone generator apparatus to date which allows a user to readily select any one of the tone generating systems or set various operational conditions and parameters for the individual tone generating systems via an input device, such a mouse, while viewing a video display using a graphical user interface (GUI) of good operability.

Further, software tone generators are extensively known today, which comprise a general-purpose computer, such as a personal computer or workstation, that generates tones, in accordance with a software program, on the basis of performance information input from an external device or performance data read out from a storage device within the computer. These software tone generators proposed today also include an integrated type where a plurality of tone generating systems are provided so that any one of them can be used as desired or as necessary. The assignee of the instant application proposed such an integrated software tone generator, for example, in Japanese Patent Application Nos. HEI-10-85106 and HEI-10-133761. The proposed integrated software tone generator is capable of adding or deleting a tone generating system to or from a lineup of the tone generating systems.

Such software tone generators, based on the use of a general-purpose computer, can significantly enhance the operability or user friendliness and also facilitate development of the software, by positively using the GUI in a window system of the general-purpose computer to make various settings for the waveform generation.

SUMMARY OF THE INVENTION

It is therefore an object of the present invention to provide a setting method and device and a waveform generating method and device which allow a user to readily make settings for a plurality of modules for executing generation and/or processing of waveform data, as well as a recording medium having stored therein a program to cause a computer to execute these methods.

To accomplish the above-mentioned object, the present invention provides a setting method for a waveform generator having a plurality of modules for executing generation and/or processing of waveform data, which comprises: a first step of displaying a common tab shareable by the plurality of modules and individual tabs for individually selecting any one of the modules and also accepting selection of a desired one of the tabs; a second step of, in response to the selection of the desired tab, displaying a dialog box visually presenting a menu of setting items corresponding to the selected tab and accepting an input to the visually presented menu of setting items; and a third step of, in response to the input to the menu, executing a setting operation for predetermined common items in the menu when the selected tab is the common tab, or executing a setting operation for a particular one of the modules in the menu when the selected tab corresponds to the particular module. Thus, in a situation where the waveform generation is carried out using the plurality of modules, the setting operation can be performed for common items shareable by the plurality of modules, in response to selection of the common tab. For items corresponding to any one of the individual modules, on the other hand, the setting operation can be performed separately for that individual module, in response to selection of the associated individual tab. Thus, the present invention can greatly enhance convenience of use or user friendliness. Further, a user's setting operation can be greatly facilitated because the user is allowed to make the tab selection and input to the menu while viewing the screen on a video display.

Among typical examples of the modules for executing generation and/or processing of waveform data is a tone generator module. There may be provided a plurality of such tone generator modules, such as PCM, FM and physical model tone generators, which correspond to the tone generating systems of different types. For example, by selecting an optimum one of the tone generator modules in response to a selected tone color, the tone waveform generation can always be carried out using an optimum tone generating system for each selected tone color. Where a plurality of different-type tone generator modules are provided like this, it is quite important to facilitate a user's setting operation, such as setting of data and/or operational conditions, for the individual tone generator modules just as proposed by the present invention. These tone generator modules may comprise a software program like a software tone generator, a DSP (Digital Signal Processor) carrying out processing in accordance with an appropriate microprogram, or a dedicated hardware device. It will be appreciated that these tone generator modules may include an effect module for imparting a tonal effect or the like and/or any other type of module, rather than being limited to the tone generator modules as noted above.

According to another aspect of the present invention, there is provided a waveform generating method which comprises: a step of registering a plurality of modules to be used for generation and/or processing of waveform data; a step of setting data relating to individual ones of the modules registered by the step of registering; a step of selecting at least one of the registered modules in accordance with tone color selection information or other selection information; and a step of generating and/or processing the waveform data by executing, in response to inputting of performance data, the module selected by the step of selecting. The step of setting data includes: a first step of displaying a common tab shareable by the plurality of modules and individual tabs for individually selecting any one of the modules and allowing selection of a desired one of the tabs displayed thereby; a second step of, in response to the selection of the desired tab, displaying a dialog box visually presenting a menu of setting items corresponding to the selected tab and accepting an input to the visually presented menu; and a third step of, in response to the input to the menu, executing a setting operation for predetermined common items in the menu when the selected tab is the common tab, and executing a setting operation for a particular one of the modules in the menu when the selected tab corresponds to the particular module. With the waveform generating method thus arranged, every module to be used in the waveform generation can be registered as necessary and only the tab for the thus-registered module is displayed in the setting process, which also greatly enhances user friendliness. For example, even where there are provided a great number of modules for potential use in the waveform generation processing, the registering step only registers a relatively small number of the modules that are considered necessary for the current processing. With such limited registration, the tabs are displayed only for the currently-necessary modules, which allows the user to view the screen with extreme ease so that the user can readily make selections on the screen.

The present invention may be arranged and implemented not only as a method but also as a device or system. The present invention may also be practiced as a program for execution by a computer, DSP or other processor, as well as a recording medium storing such a program.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Integrated software tone generator in accordance with the present invention comprises software of a tone generator driver and software of waveform generating modules, such as tone generator modules, registered therein. Tones are generated by executing an integrated software tone generator program and controlling a plurality of tone generating programs for generating tone waveform data on the basis of input performance data. Step for generating a tone includes a step of selecting at least one of the pre-registered tone generating programs and selecting a tone color (timbre) for the selected tone generating program, and a step of supplying the input performance data to the selected tone generating program. Step of setting a registered tone generator module includes a step of displaying a plurality of tabs on a video display and then displaying a setting screen of the tone generator module in response to designation of one of the tabs corresponding to the tone generator module. On the setting screen, common tabs for selecting a setting panel of the integrated software tone generator program and tabs for selecting a setting panel of the registered tone generating program are shown in a same fashion, so that there will be shown a particular setting panel in response to designation of any one of the tabs.

Figure 1:
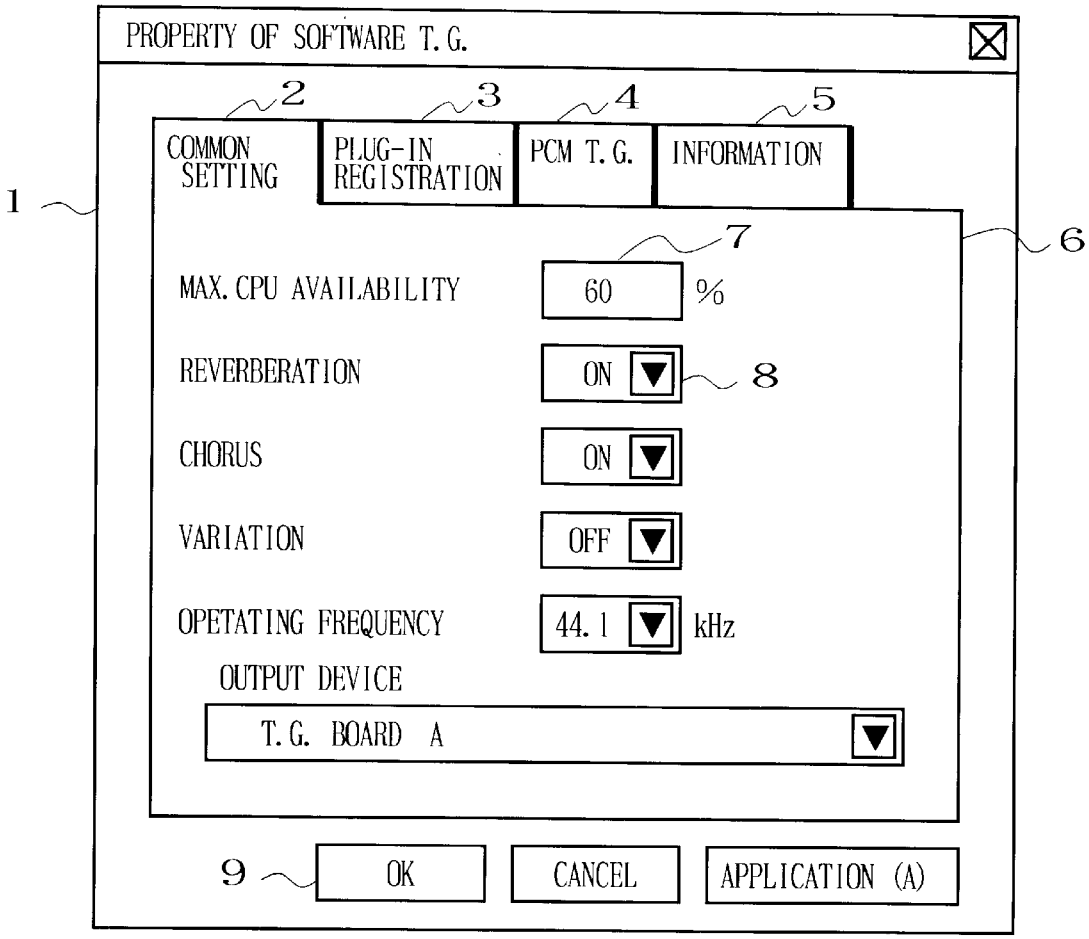
FIG. 1 is a diagram showing an example of a setting screen shown on a video display, which is explanatory of a preferred embodiment of a setting method for use in a waveform generator in accordance with the present invention.

FIG. 1 is a diagram showing a first setting screen presented on a video display, which is explanatory of a setting method for use in a waveform generator and tone generating in accordance with an embodiment of the present invention. In FIG. 1, reference numeral 1 represents a property sheet, 2 a common setting tab, 3 a plug-in registration tab, 4 a PCM tone generator (PCM T.G.) tab, 5 an information tab, 6 a common setting dialog box, 7 a text box, 8 a drop-down list box, and 9 an OK button.

The property sheet 1 is a screen via which the user is allowed to make various settings for an integrated software tone generator TG on displayed windows, and a plurality of tabbed dialog boxes are shown in the property sheet 1. FIG. 1 shows a situation where the "common setting" dialog box 6 with the common setting tab 2 is opened. The common setting dialog box 6 includes a menu of a plurality of common setting items, and the text box 7 and drop-down list box 8 for the user to enter values for the common setting items. Here, the "common setting" refers to a setting mode for entering values relating to the whole software tone generator (T.G.), rather than individual tone generator (T.G.) modules of the software tone generator, which are, however, shareable by the individual tone generator modules. Stated otherwise, the common setting mode is intended for setting various conditions of the tone generator system that is composed of the individual tone generator modules and effectors.

According to the illustrated example of FIG. 1, a maximum CPU availability rate is set in the common setting mode. In accordance with the thus-set maximum CPU availability, a maximum load on the CPU of the software tone generator is controlled and hence the number of tones to be simultaneously generated is controlled. In this common setting mode, the user can also designate presence/absence of a tonal effect, such as reverberation, chorus or variation, to be imparted to each generated tone, irrespective of which tone generating system is selected.

Further, in the common setting mode, the user can also set an operating frequency, so that operations for imparting the above-mentioned tonal effects and reproducing a generated waveform via an output device (i.e., a waveform driver and a waveform interface) are carried out at a sampling frequency specified by the thus-set operating frequency. Namely, in the illustrated example, setting the operating frequency can also control the sampling frequency of the output device. The common setting dialog box 6 also includes a drop-down list box for setting the output device.

In addition to the OK button 9, a cancel button and application (A) button are shown side by side in the first setting screen for executing and cancelling the individual settings. For other tabbed dialog boxes, there are only shown, in the first setting screen, the tabs such as the plug-in registration tab 3, PCM tone generator tab 4 and information tab 5. In the dialog box that shows up in response to a click on the information tab 5, there are displayed version information of the tone generator modules that are based on a plurality of tone synthesizing systems. Also, in the illustrated example, only the PCM tone generator tab 4 is shown as a selectable tone generator module tab; this means that no other tone generator module has been registered yet in the integrated software tone generator.

Figure 2:
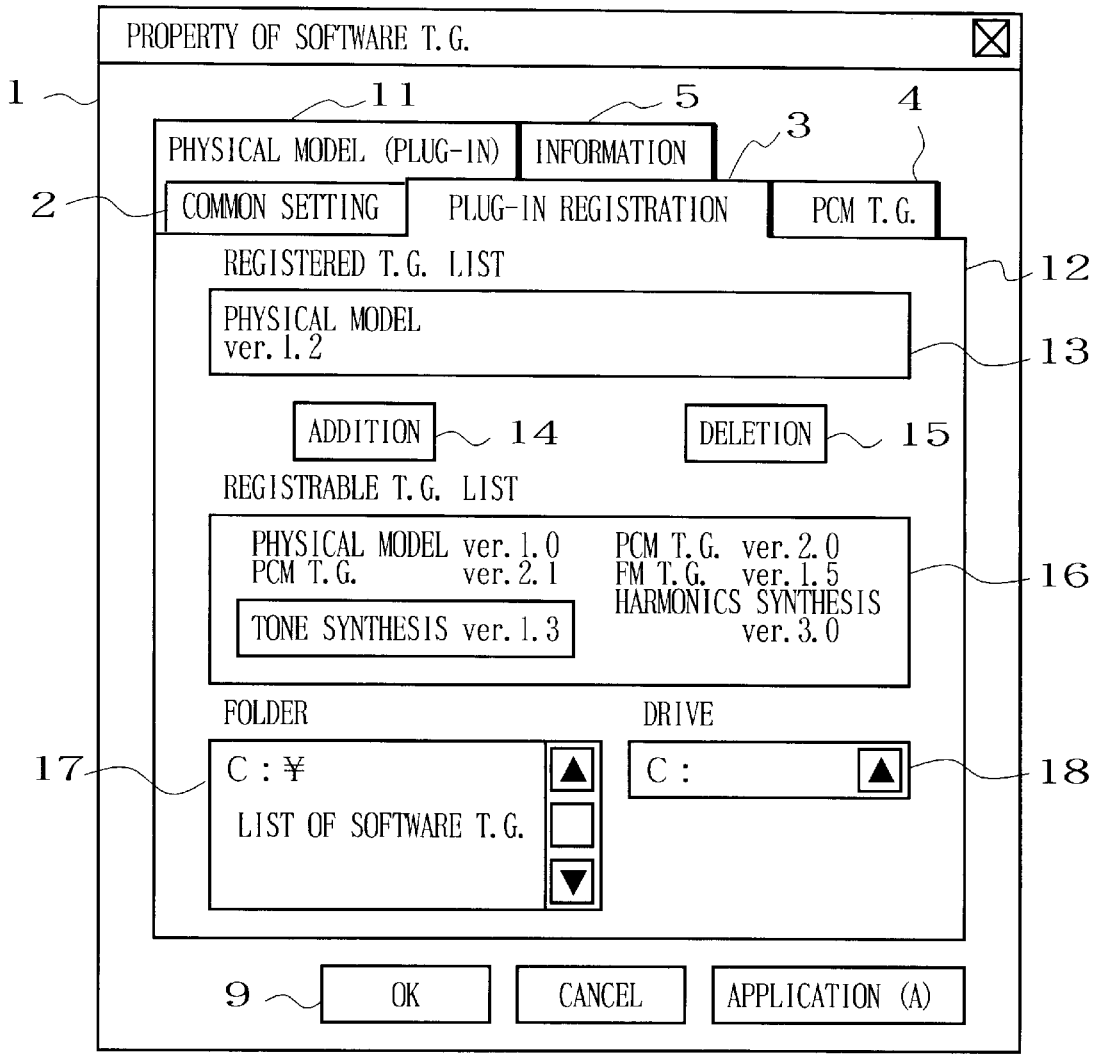
FIG. 2 is a diagram showing another example of the setting screen, which is also explanatory of the preferred embodiment of the setting method of the present invention.

FIG. 2 is a diagram showing a second setting screen shown on the video display, which is also explanatory of the setting method for use in a waveform generator and tone generating method in accordance with the embodiment of the present invention. In FIG. 2, the same elements as in FIG. 1 are denoted by the same reference numerals and will not be described here to avoid unnecessary duplication. Reference numeral 11 represents a physical model tab, 12 a plug-in registration dialog box, 13 a registered-tone-generator list box, 14 an addition button, 15 a deletion button, 16 a registrable tone generator list box, 17 a list box for designating a folder, and 18 a drop-down list box for designating a drive.

In the property sheet of FIG. 2, there is shown the plug-in registration dialog box 12 opened by using the mouse to click on the plug registration tab 3 or by simultaneously turning on TAB and CONTROL keys on a keyboard for selection of a tab. FIG. 2 shows a situation where the physical model tone generator has already been registered; thus, a physical model tab 11 not present in the example of FIG. 1 has been newly added here.

Now, describing the plug-in registration dialog box 12, the registered-tone-generator list box 13 is an area for visually presenting all tone generator modules already registered in a registration table of the integrated software tone generator. The terms "plug-in" are used herein to refer to capability of freely adding or deleting a designated function to or from a lineup of functions of the integrated software tone generator, and more particularly freely registering a designated tone generator module to or from a lineup of the tone generator modules to be used in the integrated software tone generator in such a manner that any one of the registered modules can be deleted from the lineup freely as In the illustrated example of the integrated software tone generator, the PCM tone generator is pre-registered, at the time of initial installation, as a default such that only this PCM tone generator can not be deleted from the lineup.

The following paragraph describes a procedure for adding, to the integrated software tone generator, a software tone generator module based on a new tone synthesizing system. In a predetermined folder within a hard disk storage of the computer, there is stored software of the tone synthesizing systems and software of all the tone generator modules of different versions that are available in this integrated software tone generator. Name of a desired drive is selected via the drive drop-down list box 18, and a name of the above-mentioned folder in the selected drive is selected via the folder list box 17. In this way, the tone generator modules stored in the potential tone generator list box 16 show up on the display. As the user clicks on a tone generator module name not registered in the registration table and then clicks on the addition button 14, the clicked-on or to-be-added tone generator module shows up in the registered-tone-generator list box 13. Then, clicking on the OK button 9 completes the registration of the tone generator module. Only the thus-registered tone generator modules (excluding the PCM tone generator) can be used in waveform generation processing.

Deletion of a registered tone generator module is carried out as follows. The user first clicks on a tone generator module name shown in the registered-tone-generator list box 13 which is to be deleted and then clicks on the deletion button 15. This way, the clicked-on or to-be-deleted tone generator module disappears from the registered-tone-generator list box 13. Then, clicking on the OK button 9 completes the deletion of the tone generator module from the registration list.

Figure 3:
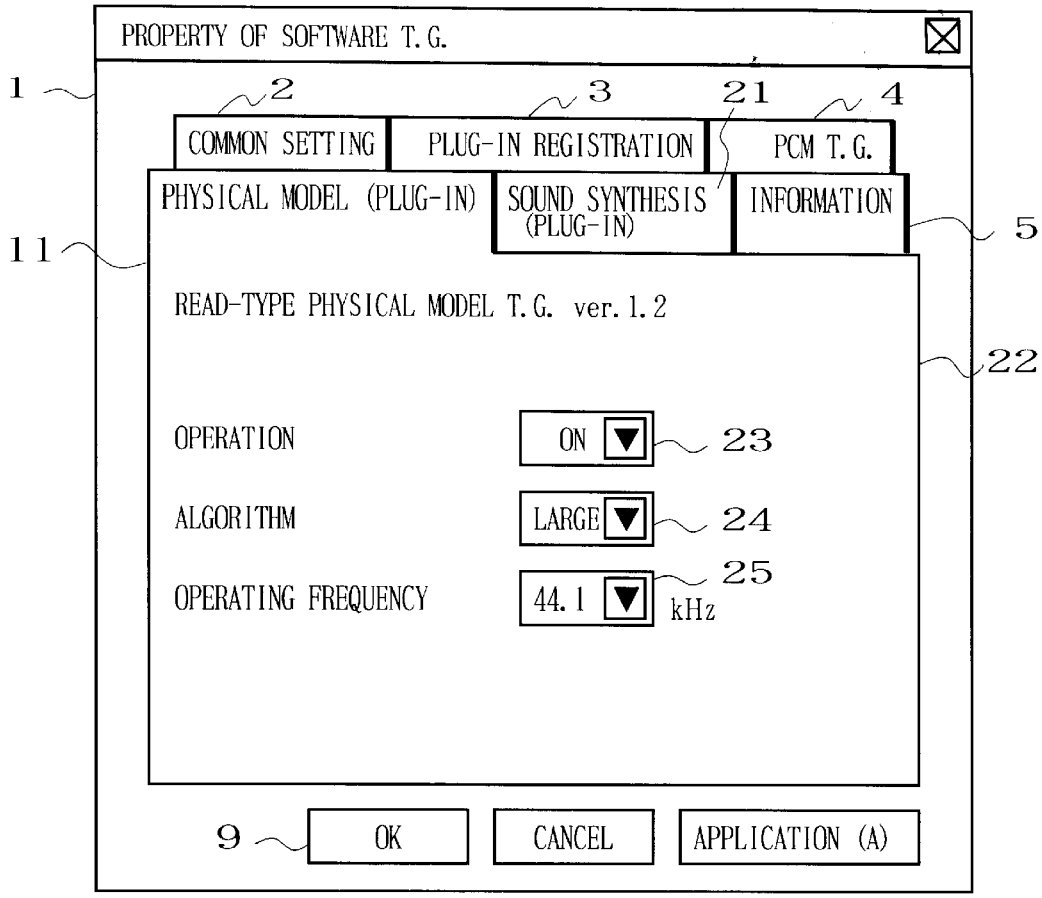
FIG. 3 is a diagram showing still another example of the setting screen, which is also explanatory of the preferred embodiment of the setting method of the present invention.

Further, FIG. 3 is a diagram showing a third setting screen shown on the video display, which is also explanatory of the setting method for use in a waveform generator and tone generating method in accordance with the embodiment of the present invention. In FIG. 3, the same elements as in FIG. 1 or 2 are denoted by the same reference numerals and will not be described here to avoid unnecessary duplication. Reference numeral 21 represents a sound-synthesizing tone generator tab, 22 a physical-model-tone-generator setting dialog box, and 23–25 drop-down list boxes.

In the property sheet 1 of FIG. 3, the physical-model-tone-generator setting dialog box 22 is opened as a result of a click on the physical model tab 11. FIG. 3 also shows a situation where a sound-synthesizing tone generator has already been registered; thus, a sound-synthesizing tone generator tab 21 not present in the example of FIG. 1 has been newly added here.

The physical-model-tone-generator setting dialog box 22 in the illustrated example is a box via which the user is allowed to make settings for a registered physical model tone generator module. OPERATION selection via the drop-down list box 23 is for selectively turning-on or off of operation in a situation where the physical model tone generator is registered, which can quickly turn ON or OFF the physical model tone generator module. ALGORITHM selection via the drop-down list box 24 is for selecting a size of a waveform generating algorithm to be carried out in the physical model from among three options; large size; medium size; and small size. As the waveform generating algorithm size becomes greater, a tone of a more complicated color can be generated, but a greater load would be imposed on the CPU. OPERATING FREQUENCY selection via the drop-down box 25 is for selecting a sampling frequency of a waveform to be generated by the physical model tone generator module. As the operating frequency becomes lower, the load on the CPU can be reduced, but the frequency band of a generated tone would be narrowed.

When an operating frequency of a driver for the main body of the integrated software tone generator is set via the common setting dialog box of FIG. 1 and an operating frequency, different from that for the main body driver, is set in the physical model tone generator (i.e., individual tone generator module), the sampling frequency of waveform data generated by the physical model tone generator module is converted into the sampling frequency of the main body driver. Namely, in the case where a sampling frequency, different from the sampling frequency previously set as a common setting item, is set for some individual tone generator module, waveform data are generated by the individual tone generator module with the thus-set individual sampling frequency and then its sampling frequency is converted into the common sampling frequency. The algorithm designated via the drop-down box 24 is unique to the physical model and can be selected from among various algorithms ranging from complicated algorithms to simple algorithms.

The above-mentioned ON/OFF state and operating frequency are also set via a dialog box that is opened for almost every tone generator module registered in the registration list, although not specifically shown. There are other setting items, than the above-mentioned, which are peculiar to the tone generating system of each designated tone generator module. The "sound-synthesizing tone module" is a formant singing tone generator, for which the user can set a maximum number of formants. In the case of an FM tone generator module, the setting items include the "number of operators" and the number of envelope generator (EG) segments; in the case of the PCM tone generator, the setting items include "selection of a waveform data set" and the "number of orders of digital controller filter (DCF)". Note that the DCF is a digital filter for controlling a color of a tone to be generated.

As set forth above, the settings shareable by a plurality of the tone generator modules can be made via the common setting dialog box. Also, in the property sheet, there are shown respective tabs of the individual tone generator modules registered in the registration list. By viewing the thus-displayed tabs, it is possible to readily ascertain which tone generator modules are currently registered. Further, by selecting a particular one of the tabs, it is possible to display an individual setting dialog box for each of the registered tone generator modules. Whereas the instant embodiment has been described as registering a desired tone generator module via the plug-in registration tab dialog box in the property sheet, the registration of the tone generator module need not necessarily be effected via the property sheet of the software tone generator; that is, the tone generator module registration may be performed via another dedicated menu screen. In an alternative, there may be displayed only one tab for selecting an individual tone generator module so that a list of all the individual tone generator modules selectable by the user will show up in response to a click on this tab.

Figure 4:
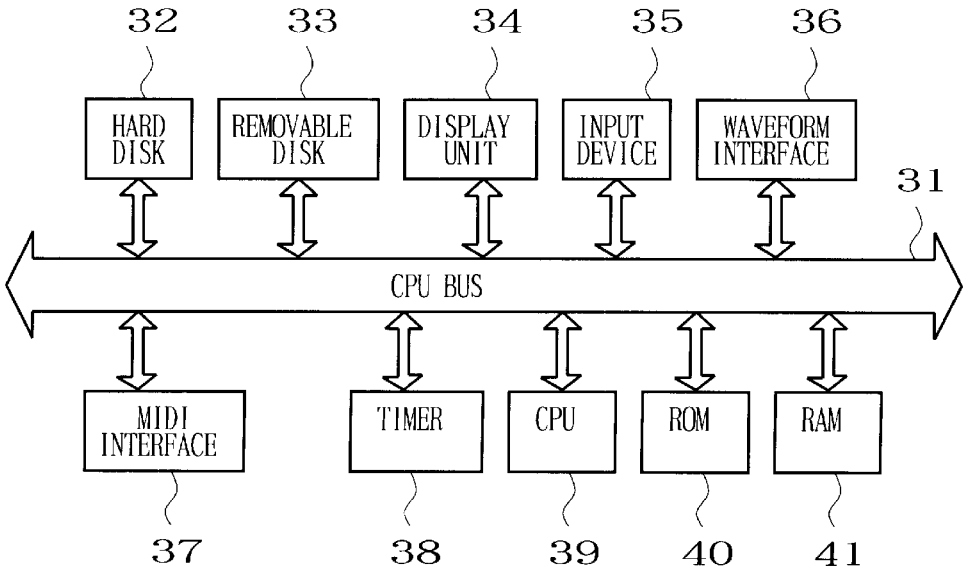
FIG. 4 is a block diagram showing an exemplary hardware setup used for implementation of the present invention.

FIG. 4 is a block diagram showing an exemplary hardware setup for implementation of the setting method for use in a waveform generator and tone generating method in accordance with the embodiment of the present invention. In the figure, reference numeral 31 represents a CPU bus, 32 a hard disk drive (HDD), 33 a removable disk drive such as a CD-ROM drive, 34 a display unit, 35 an input device including a keyboard and a mouse, 36 a waveform interface, 37 a MIDI (Musical Instrument Digital Interface) interface, 38 a timer, 39 a microprocessor (CPU), 40 a read-only memory (ROM), and 41 a random access memory (RAM). Data are exchanged between these elements via the CPU bus 31.

The setting method and tone generating method of the present invention are carried out, under the control of the CPU 39, as processing based on a tone-generation control program, along with other processing based on other application programs. In the ROM 40, there are prestored a basic input/output system (BIOS) program. The RAM 41 includes a working area for the CPU 39 and other areas into which are loaded an operating system, application program performance data, etc. read out from external storage devices such as the hard disk drive 32 and removable disk drive 33. The timer 38 serves to indicate timing of a timer interrupt process to the CPU 39. The MIDI interface 37 is an interface for introducing performance data, such as MIDI data, from an external MIDI instrument and outputting generated MIDI data to another MIDI instrument.

The display unit 34 includes a video display, such as a CRT (Cathode Ray Tube) or an LCD (Liquid Crystal Display), that is used to implement the setting method and tone generating method of the present invention. The input device 35, including the keyboard and the mouse, is provided for entering letters, numbers and the like that are used for the implementation of the setting method and tone generating method. The waveform interface 36 is provided for reading out a generated tone waveform from the RAM 41, converting the read-out waveform into analog signals and then audibly reproducing (or sounding) the analog signals by means of a sound system (not shown). There may be further provided a communication interface for connection to a LAN (Local Area Network) or the internet.

The above hardware organization is generally similar to that of ordinary personal computers and workstations, and therefore the setting method and tone generating method of the present invention can be implemented using a general-purpose computer, although they may of course be implemented by a dedicated tone generator device. Control programs for executing the setting method and tone generating method of the present invention are provided, for example, from a CD-ROM prestoring the programs, loaded into a CD-ROM drive constituting the removal disk drive 33, and then installed into a recording medium placed in the hard disk drive 32.

FIGS. 5 to 8 are flow charts explanatory of processing for generating tones using the tone generating method in accordance with the embodiment of the present invention. The following descriptions will be made in relation to a personal computer where Windows 95 (registered trademark of Microsoft Corporation) is installed as its operating system, although the present invention is not limited to the use of such a computer.

Figure 5:
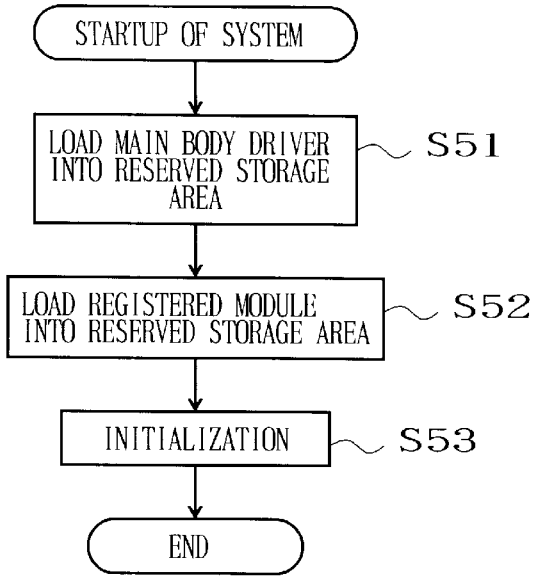
FIG. 5 is an exemplary flow chart explanatory of processing for generating tones using a waveform generating method in accordance with an embodiment of the present invention, and particularly showing processing carried out at start up of a computer system.

FIG. 5 is a flow chart showing processing carried out at start up of the computer system. At step 51, a storage area is reserved in the main memory (the RAM 41 of FIG. 4) of the computer, and the driver for the main body of the integrated software tone generator is loaded into the storage area. At next step S52, another storage area is reserved in the main memory of the computer, and data indicative of the tone generator modules registered in the registration table, managed by the integrated software tone generator, are loaded into the reserved storage area. At step S53, an initialization process is carried out.

Figure 6:
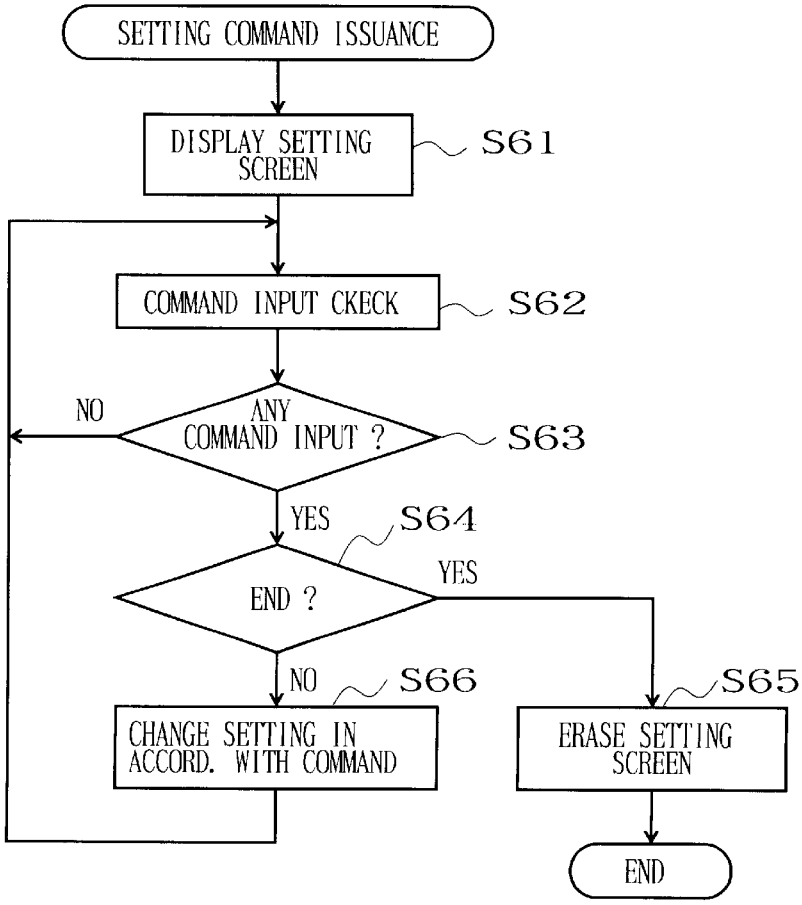
FIG. 6 is another exemplary flow chart explanatory of the processing for generating tones using the embodiment of the waveform generating method, and particular showing processing carried out when a setting command is issued.

FIG. 6 is a flow chart showing processing carried out when a setting command is issued. Command to set the software tone generator is issued by the user performing any one of the following operations. First, the user clicks on a start button in a task bar, clicks on a "program" button to open a program menu, and then clicks on a "software tone generator program" in the program menu to select "setting of software tone generator". Second, the user clicks on an icon of "software tone generator" within a control panel window. Third, the user clicks on a mini icon of "software tone generator" shown in a task bar of the desktop screen.

At next step S61, a setting screen, which is the property sheet as shown in one of FIGS. 1 to 3, is shown on a window. Then, the computer performs command input check at step S62 and then determines at step S63 whether or not there has been a command input. If answered in the affirmative at step S63, the computer proceeds to step S64; otherwise, the computer reverts to step S62. The command input is normally done using a pointing device such as the above-mentioned keyboard and/or mouse. A further determination is made at step S64 as to whether the input command is an end command. If so, the computer goes to step S65 to erase the setting screen and terminate the processing. If the input command is not an end command as determined at step S64, the computer proceeds to step S66 and reverts to step S62. The end command is issued in response to a user click on any one of a "close (x)" button at the upper right corner of the property sheet, OK button 9 and cancel button.

When an instruction to add a new tone generator module is entered at step S62 during display of the setting screen of FIG. 2, data indicative of the tone generator module to be added, such as the name and identification number of the module, are written into the registration table at step S66 so that the new tone generator module is registered in the main body driver. When, on the other hand, some tone generator module is to be deleted, it is only necessary that the data indicative of the tone generator module be deleted from the registration table. Note that when the "OPERATION" is selected to be OFF in the tabbed dialog box of a particular tone generator module, this tone generator module is prevented from being used in the tone generation processing.

When a tab selection instruction is entered at step S62, the computer carries out a process for displaying a dialog box corresponding to the selected tab. Further, when an instruction to set a new operating frequency is entered at step S62 during display of the "common setting" dialog box of FIG. 1, the computer varies the sampling frequency for an effect imparting process etc. in the software tone generator and also varies the sampling frequency for the waveform driver and waveform interface at step S66. Furthermore, when an instruction to turn OFF the OPERATION is input at step S62 during display of the "physical model" dialog box of FIG. 3, the computer turns off the operation of the physical model tone generator module at step S66, at which time a substitute tone generator module, capable of generating a tone color similar to that produced by the physical model tone generator module, is registered for a part where the physical model tone generator module has been so far set.

According to the above-described embodiment, necessary settings for addition or deletion of a tone generator module and a change in the settings of the registered tone generator module are made after the startup of the computer system, and the thus-made settings are caused to be reflected immediately on the integrated software tone generator in response to a user click on the OK button 9 or application button. Besides, these settings are left preserved even after termination of the system operation. In an alternative, the settings for addition or deletion of a registered tone generator module may be reflected on the integrated software tone generator only after the terminated system operation is resumed and may be preserved after the operation resumption. In another alternative, the settings for addition or deletion of a registered tone generator module may be permitted only at or after re-installation of the software.

Figure 7:
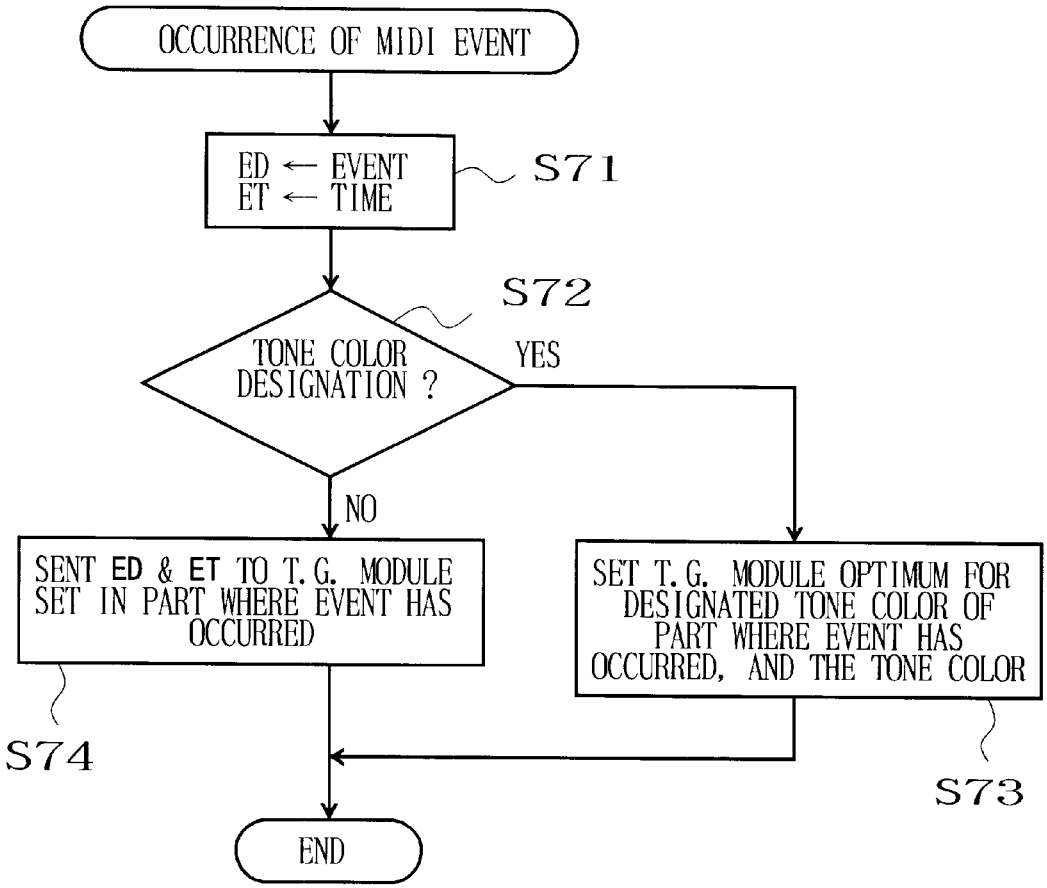
FIG. 7 is still another exemplary flow chart explanatory of the processing for generating tones using the embodiment of the waveform generating method, and particularly showing processing carried out in response to MIDI event occurrence.

FIG. 7 is a flow chart of a process carried out in response to MIDI event occurrence. MIDI events occur, during execution of sequence software, in accordance with time management by the software, or MIDI events occur on the basis of MIDI data received via the MIDI interface 37 of FIG. 4 from an external instrument.

At step S71 of FIG. 7, contents of the MIDI event are set into an event data (ED) register, and the occurrence time (absolute time) of the event is set into an event time (ET) register. Then, it is determined at next step S72 whether or not the MIDI event is tone color designation. If the MIDI event is tone color designation, the computer moves to step S73; otherwise, the computer proceeds to step S74. After step S73 or S74, the processing of FIG. 7 is terminated.

Examples of the tone-color designating event include a "bank select" event and a "program change" event. In each of these events is designated a particular part. Therefore, step S73 sets a tone generator module optimum for the tone color designated for the part and sets the tone color. To this end, optimum tone generating systems are prestored in corresponding relation to selectable tone colors so that one of the default PCM tone generator and other registered tone generator modules in the integrated software tone generator is selected in accordance with the designated tone color.

For example, in a situation where a tone generator module based on the tone generating system corresponding to the designated tone color is already registered in the software tone generator and that tone generator module is in the ON state, the tone generator module based on the optimum tone generating system as well as the designated tone color is selected. In other situations than this, a tone color, similar to the designated tone color, is selected from the default PCM tone generator. It will be appreciated that another tone generator module than the PCM tone generator, based on a tone generating system capable of reproducing the similar tone color, may be selected. Tone color selection responsive to the bank select or program change event is made independently for each MIDI part. Accordingly, the tone generator module and tone color selected in the above-mentioned manner are set independently for each MIDI part.

If the MIDI event is an note-on event as determined at step S72, the computer goes to step S74, where the event data and time, set in the respective registers ED and ET at step S71, are sent to a tone generator module currently set for the part where the event has occurred. Although not specifically shown, the tone generator module having thus received the event data and time carries out a routine for processing the MIDI event. For example, if the MIDI event is an note-on event, the processing routine sets, in a tone generator register, a plurality of parameters for generating a tone corresponding to the note-on event. If the MIDI event concerns an after-touch function, then the routine changes tone volume controlling parameters and tone color controlling parameters currently set in the tone generator register.

Figure 8:
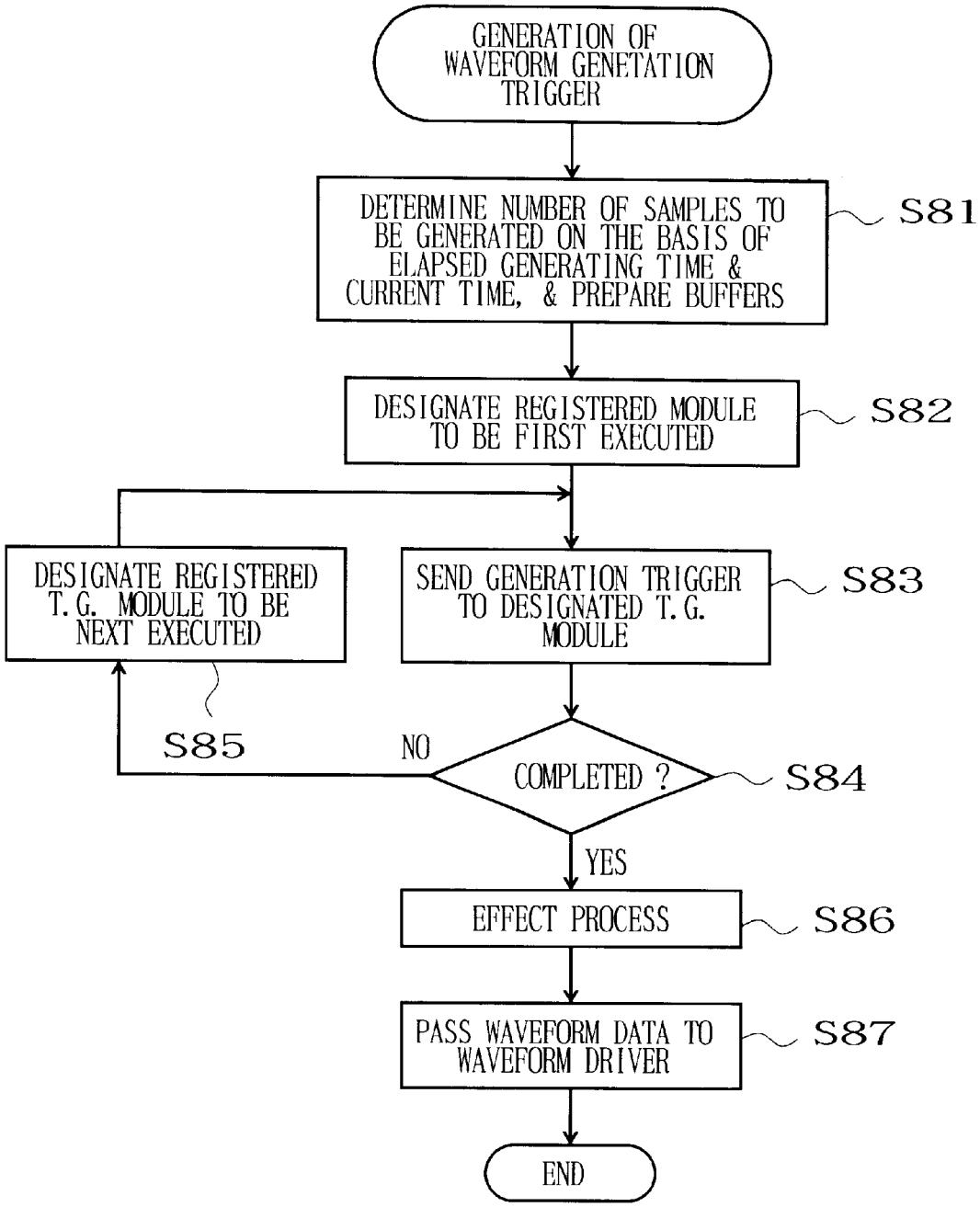
FIG. 8 is still another exemplary flow chart explanatory of the processing for generating tones using the embodiment of the tone generating method, and particularly showing processing carried out in response to a waveform generation trigger signal.

FIG. 8 is a flow chart showing processing carried out in response to a waveform generation trigger signal that is supplied from the operating system every predetermined time interval. Here, in response to a series of the waveform generation trigger signals, tone generator modules entered in the order of execution are activated or turned on in a sequential manner.

At step S81, a specific number of samples to be generated from now on is determined on the basis of an elapsed generating time and current time, and zeroth to third buffers are prepared . At following step S82, one of the tone generator modules that is to be executed first (first-to-be-executed tone generator module) is designated. Each tone generator module set for any one of the parts is incorporated into the order of execution. According to the order of execution, such a tone generator module which often takes charge in an important part of the physical model tone generator or the like is given priority over the other tone generator modules, while the tone generator modules, such as the PCM tone generator, where the number of tones to be generated can be increased or decreased as required in the light of the load are given lower priority.

The waveform generation trigger signal is forwarded to the designated tone generator module at next step S83, and then the computer moves on to step S84. Although not specifically shown, the tone generator module having thus received the waveform generation trigger signal carries out a tone generating routine, where the designated number of samples of tone waveform data corresponding to the parameters of the tone generator module are generated and accumulatively stored into the zeroth to third buffers after being weighted differently on a buffer-by-buffer basis.

Then, at step S84, a determination is made as to whether the processing has been completed up to the last tone generator module in the order of execution (last-to-be-executed tone generator module. With a negative (NO) determination at step S84, the computer branches to step S85, but with an affirmative (YES) determination, the computer proceeds to step S86. By the time the processing is completed for the last-to-be-executed tone generator module, a mixed waveform of four-channel waveform data, generated by a plurality of the tone generator modules, has been stored in each of the zeroth to third buffers up to the number of samples as designated earlier at step S81.

At step S85, the computer designates the next tone generator module in the order of execution (next-to-be-executed tone generator) and then reverts to step S83. After completion of the processing for the last-to-be-executed tone generator module, the computer proceeds to step S86, where an effect imparting operation is carried out on the waveform data stored in the zeroth to third buffers. The effect imparting operation imparts any one of the reverberation, chorus and variation effects. The first to third buffers are for storing input data to be subjected to the effect imparting operation, while the zeroth buffer is for directly outputting the data with no effect imparted thereto. The waveform data generated by the designated tone generator module are cumulatively stored into the individual buffers after being weighted with so-called "send levels". Reverberation, chorus and variation effects are imparted to the waveform data of the first to third buffers, respectively, and the resultant effect-imparted waveform data are added to the waveform data of the direct-output or zeroth buffer. Then, at step S87, the designated number of samples of the waveform data having been stored in the zeroth buffer are passed to the waveform driver as "waveform data to be reproduced". The waveform driver reproduces the currently-passed waveform data, following reproduction of the waveform data passed thereto previously.

Finally, a description will be made about a software configuration of the integrated software tone generator including the software tone generator modules, assuming that the software tone generator also includes effect modules.

In the operating system, there are incorporated an integrated driver, a plurality of the tone generator modules and a plurality of the effect modules, and each of these modules is called or invoked by the integrated driver. The integrated software tone generator includes a TGM table for storing the names of the registered tone generator modules (similarly to the above-described registration table) and an EFM table for storing the names of the registered effect modules.

Performance part data are stored in corresponding relation to the 16 MIDI parts, and the part data for each of the MIDI parts include a tone module number designating a tone generator module to be used for the part concerned, along with a tone color number and "pan" data.

MIDI event processing module, incorporated in the integrated driver and having a function of distributing MIDI data, selectively supplies generated MIDI data to the tone generator modules as designated by the above-mentioned part data. This processing routine corresponds to the routine of FIG. 7 that is executed in response to each MIDI event occurrence. In some cases, certain MIDI data are sent to one of the effect modules corresponding to the tone color.

Each of the tone generator modules passes the generated tone waveform data to a processing module that performs trigger management and buffer management in the integrated software tone generator module. The tone waveform data thus passed to the processing module is supplied to any of the effect modules, and output waveform data from the effect module is added to the waveform data left unsupplied to the effect module so that the thus-added waveform data is sent to a coder/decoder (CODEC) driver that corresponds to the above-described waveform driver. The CODEC driver, in turn, delivers the waveform data to a CODEC, where the waveform data is converted into analog representation.

Because different operating frequencies can be set for the individual tone generator modules and the integrated software tone generator module, each of the tone generator modules is arranged to convert the sampling frequency of the waveform data, generated at its operating frequency, into the operating frequency of the integrated software tone generator module, before cumulatively storing the waveform data into the zeroth to third buffers.

In the foregoing, the tone generator module has been described as an example of the waveform generating module, where various kinds of setting operations are carried out for the registered tone generator modules, as well as the setting operations for addition or deletion of a particular one of the registered tone generator modules. According to the present invention, such setting operations may also be performed in the waveform generating modules in the above-mentioned manner, such as the effect modules and performance data processing modules that execute filtering, conversion and the like of the performance data.

The above descriptions have been made about setting operations for the waveform generating module in the integrated software tone generator. In addition to such an integrated software tone generator, there have been known tone generator apparatus provided with a plurality of waveform data generating devices. For instance, the assignee of the present application has commercialized a tone generator apparatus under the model name of "MU100". With a plug-in system for installation of an extension board, a desired physical model tone generator and/or a formant singing tone generator can be added to the main body of a waveform memory tone generator. Then, these waveform data generating devices can be readily set to desired conditions by implementing the above-described setting method for the waveform generator while viewing video screens of a personal computer connected to the tone generator apparatus. In this case, a waveform data generation setting program may be installed in the personal computer.

In summary, as apparent from the above descriptions, the present invention affords the benefit that by only viewing tabs on a setting screen of a waveform generating facility or program, the user can readily ascertain which waveform generating facilities or programs have been registered. Further, because the present invention can cause a setting screen, corresponding to a desired one of the tabs, to be promptly displayed by the user only selecting the desired tab, the invention allows the user to readily shift from one setting item to another.

In addition, the selecting method using such a tab display screen is quite familiar to almost every user, because it is similar in principle to setting screens of various familiar application software such as a word processor. As a consequence, the present invention advantageously facilitates a selecting operation by the user.

What is claimed is:

1. A setting method for use in a waveform generator having a plurality of modules for executing generation and/or processing of waveform data, said setting method comprising:

a first step of displaying a common tab shareable by the plurality of modules and individual tabs for individually selecting any one of the modules and also accepting selection of a desired one of the tabs;

a second step of, in response to the selection of the desired tab, displaying a dialog box visually presenting a menu of setting items corresponding to the selected tab and accepting an input to the visually presented menu; and a third step of, in response to the input to the menu, executing a setting operation for predetermined common items in the menu when the selected tab is the common tab, and executing a setting operation for a particular one of the modules in the menu when the selected tab corresponds to the particular module.

2. A setting method as recited in claim 1 which further comprises a fourth step of registering or renewing the plurality of modules by adding or deleting a designated module to or from a lineup of modules to be used in said waveform generator.

3. A setting method as recited in claim 1 wherein the predetermined common items corresponding to the common tab includes at least one of an item for setting a maximum availability of a CPU, an item for setting an ON or OFF state of a given tonal effect, and an item for setting a waveform-generating sampling frequency.

4. A setting method as recited in claim 1 wherein said plurality of modules include a plurality of tone generator modules of different types.

5. A setting method as recited in claim 1 wherein said plurality of modules include a tone generator module for generating waveform data in accordance with performance data, or an effect module for imparting a given tonal effect to waveform data.

6. A setting method as recited in claim 1 wherein at least one of the modules comprises a program executable by a computer.

7. A setting method as recited in claim 1 wherein at least one of the modules comprises a dedicated hardware device.

8. A machine-readable recording medium containing instructions of a program executable by a processor for setting data in a waveform generator having a plurality of modules for executing generation and/or processing of waveform data, said program comprising:

a first step of displaying a common tab shareable by the plurality of modules and individual tabs for individually selecting any one of the modules and also accepting selection of a desired one of the tabs;

a second step of, in response to the selection of the desired tab, displaying a dialog box visually presenting a menu of setting items corresponding to the selected tab and accepting an input to the visually presented menu; and a third step of, in response to the input to the menu, executing a setting operation for predetermined common items in the menu when the selected tab is the common tab, and executing a setting operation for a particular one of the modules in the menu when the selected tab corresponds to the particular module.

9. A setting device for use in a waveform generator having a plurality of modules for executing generation and/or processing of waveform data, said setting device comprising:

a display;

a first control section that displays, on said display, a common tab shareable by the plurality of modules and individual tabs for individually selecting any one of the modules and also accepts selection of a desired one of the tabs;

a second control section that, in response to the selection of the desired tab, displays on said display a dialog box visually presenting a menu of setting items corresponding to the selected tab and accepts an input to the visually presented menu; and a third control section that, in response to the input to the menu, executes a setting operation for predetermined common items in the menu when the selected tab is the common tab, and executes a setting operation for a particular one of the modules in the menu when the selected tab corresponds to the particular module.

10. A setting method for use in a waveform generator provided with a plurality of waveform processor modules including a plurality of tone generator modules of different types, said setting method comprising:

a first step of displaying, on a display, a screen for setting common operational conditions shareable by the plurality of modules; and second step of displaying, on the display, a screen for setting individual operational conditions for each of the plurality of modules and setting the individual operational conditions by use of the screen.

11. A setting method as recited in claim 10 which further comprises a third step of, when the common operational condition and individual operational condition set for a same item by said first step and said second step, respectively, are different in content from each other, processing waveform data in accordance with the set individual operational conditions by means of one of the modules that corresponds to the individual operational conditions, and then converting the processed waveform data in accordance with the common operational conditions.

12. A setting method as recited in claim 11 wherein said same item is a sampling frequency of the waveform data.

13. A setting method as recited in claim 10 which further comprises a third step of registering or renewing the plurality of modules by adding or deleting a designated module to or f from a lineup of modules to be used in said waveform generator, and wherein said second step selectively sets the individual operational conditions for the plurality of modules registered or renewed by said third step.

14. A setting device for use in a waveform generator provided with a plurality of waveform processor modules including a plurality of tone generator modules of different types, said setting device comprising:

a display;

a first control section that displays, on said display, a screen to select between a common mode for setting common operational conditions shareable by the plurality of modules and an individual mode for setting individual operational conditions for each of the plurality of modules, to permit selection between the common mode and the individual mode; and a second control section that is responsive to selection of the common mode for displaying, on said display, the screen for setting the common operational conditions shareable by the plurality of modules in such a way that setting of the common operational conditions is permitted via the screen, and is responsive to selection of the individual mode for displaying, on said display, the screen for setting the individual operational conditions peculiar to a selected one of the modules in such a way that setting of the individual operational conditions peculiar to the selected module is permitted via the screen.

15. A waveform generating method comprising:

a step of registering a plurality of modules to be used for generation and/or processing of waveform data;

a step of setting data relating to individual ones of the modules registered by said step of registering;

a step of selecting at least one of the registered modules in accordance with tone color selection information or other selection information; and a step of generating and/or processing the waveform data by executing, in response to inputting of performance data, the module selected by said step of selecting, wherein said step of setting data includes:

a first step of displaying a common tab shareable by the plurality of modules and individual tabs for individually selecting any one of the modules and allowing selection of a desired one of the tabs displayed thereby;

a second step of, in response to the selection of the desired tab, displaying a dialog box visually presenting a menu of setting items corresponding to the selected tab and accepting an input to the visually presented menu; and a third step of, in response to the input to the menu, executing a setting operation for predetermined common items in the menu when the selected tab is the common tab, and executing a setting operation for a particular one of the modules in the menu when the selected tab corresponds to the particular module.

16. A machine-readable recording medium containing instructions of a program executable by a processor for generating a waveform generator, said program comprising:

a step of registering a plurality of modules to be used for generation and/or processing of waveform data;

a step of setting data relating to individual ones of the modules registered by said step of registering;

a step of selecting at least one of the registered modules in accordance with tone color selection information or other selection information; and a step of generating and/or processing waveform data by executing, in response to inputting of performance data, the module selected by said step of selecting, wherein said step of setting data includes:

a first step of displaying a common tab shareable by the plurality of modules and individual tabs for individually selecting any one of the modules and allowing selection of a desired one of the tabs displayed thereby;

a second step of, in response to the selection of the desired tab, displaying a dialog box visually presenting a menu of setting items corresponding to the selected tab and accepting input to the visually present menu; and a third step of, in response to the input to the menu, executing a setting operation for predetermined common items in the menu when the selected tab is the common tab, and executing a setting operation for a particular one of the modules in the menu when the selected tab corresponds to the particular module.

17. A waveform generating device comprising:

a display;

a registration section that registers a plurality of modules to be used for generation and/or processing of waveform data;

a setting section that sets data relating to the modules registered by said registration section; said setting section including: a first control section that displays, on said display, a common tab shareable by the plurality of modules and individual tabs for individually selecting any one of the modules and also accepts selection of a desired one of the tabs; a second control section that, in response to the selection of the desired tab, displays on said display a dialog box visually presenting a menu of setting items corresponding to the selected tab and accepts an input to the visually presented menu; and a third control section that, in response to the input to the menu, executes a setting operation for predetermined common items in the menu when the selected tab is the common tab and executes a setting operation for a particular one of the modules in the menu when the selected tab corresponds to the particular module;

a selection section that selects at least one of the registered modules in accordance with tone color selection information or other selection information; and a section that generates and/or processes waveform data by executing, in response to inputting of performance data, the module selected by said selection section.

* * * * *